US006405866B2

(12) United States Patent
Arima

(10) Patent No.: US 6,405,866 B2
(45) Date of Patent: Jun. 18, 2002

(54) SHOCK ABSORBING DEVICE

(75) Inventor: Seibi Arima, Tachikawa (JP)

(73) Assignee: Teac Corporation, Tokyo (JP)

( * ) Notice: Subject to any disclaimer, the term of this patent is extended or adjusted under 35 U.S.C. 154(b) by 0 days.

(21) Appl. No.: 09/848,148

(22) Filed: May 3, 2001

Related U.S. Application Data

(63) Continuation of application No. 09/148,599, filed on Sep. 4, 1998, now abandoned.

(30) Foreign Application Priority Data

Sep. 8, 1997 (JP) ..... 9-242971

(51) Int. Cl.[7] ..... B65D 85/48
(52) U.S. Cl. ..... 206/453; 206/586; 206/592
(58) Field of Search ..... 206/453, 454, 206/586, 591, 592, 814, 823

(56) References Cited

U.S. PATENT DOCUMENTS 4,522,303 A * 6/1985 Starr ..... 206/588
4,700,832 A * 10/1987 Champ ..... 206/320
4,972,954 A * 11/1990 Dickie ..... 206/523
5,024,328 A * 6/1991 Bontrager ..... 206/453
5,148,920 A * 9/1992 Walker ..... 206/523
5,160,473 A * 11/1992 Bontrager ..... 264/138
5,215,195 A * 6/1993 Williams ..... 206/446

FOREIGN PATENT DOCUMENTS

| | | |
|---|---|---|
| JP | 54-136176 | 3/1978 |
| JP | 54-139678 | 3/1978 |
| JP | 54-30266 | 3/1979 |

* cited by examiner

*Primary Examiner*—Shian Luong
(74) *Attorney, Agent, or Firm*—Anderson Kill & Olick; Eugene Lieberstein; Michael N. Meller

(57) ABSTRACT

A shock absorbing device includes a first arm portion and a second arm portion. The first arm portion is made of resin having a shock absorbing function. The second arm portion is made of resin having a shock absorbing function, and is jointed with the first arm portion at, at least two positions. The first arm portion includes at least one deformation portion. The second arm portion includes at least one deformation portion. A fitting space is formed between the first and second arm portions as a result of the deformation portions being deformed, a to-be-shock-absorbed article being held in the fitting space.

4 Claims, 9 Drawing Sheets

SHOCK ABSORBING DEVICE

This application is a continuation Ser. No. 09/148,599 filed Sep. 4, 1998, now abandoned.

BACKGROUND OF THE INVENTION

1. Field of the Invention

The present invention relates to shock absorbing devices and, in particular, to a shock absorbing device which is fitted at corner portions or the like of a to-be-shock-absorbed article and performs a shock absorbing function on the to-be-shock-absorbed article.

2. Description of the Related Art

Generally speaking, when an electronic device such as a floppy disk device, a CD-ROM device or the like is shipped, shock absorbing devices are fitted to the electronic device, in order to protect the electronic device from a shock during transportation. As a shock absorbing device, a device made of expanded polystyrene is used in many cases. Positions of an electronic device at which shock absorbing devices are to be fitted are selected to two ends, corners or the like which are likely to be damaged during transportation.

FIG. 1 shows an example of shock absorbing devices in the related art. The shock absorbing devices 2 are made of expanded polystyrene, and are fitted at the two ends of an electronic device 4, respectively. As shown in the figure, each of the shock absorbing devices 2 has a shape of a rectangular parallelepiped, and has a recess portion 6 into which the electronic device 4 is fitted.

In order to form the recess portion 6 in each shock absorbing device 2, a metal mold for forming the shock absorbing device 2 has an appropriate shape. Alternatively, after a rectangular-parallelepiped shape is formed, a recess portion 6 is formed as a result of one side of the rectangular-parallelepiped shape being hollowed out.

However, when the recess portion 6 is formed by using the metal mold having the appropriate shape, the shape of the metal mold is complicated, and thereby, the cost of the shock absorbing device 2 is expensive.

When the recess portion 6 is formed as a result of one side of a rectangular-parallelepiped shape being hollowed out, it is difficult to process expanded polystyrene in high accuracy. As a result, it is difficult to form the recess portion 6 having a shape corresponding to the outer shape of the electronic device 4 in high accuracy.

Specifically, when the recess portion 6 is smaller than the outer shape of the electronic device 4, it is not possible to fit the shock absorbing device 2 to the electronic device 4. When the recess portion 6 is larger than the outer shape of the electronic device 4, the electronic device 4 may move in the recess portion 6. Thereby, the shock absorbing function of the shock absorbing device 2 is degraded, and it may not be possible for the electronic device 4 to be positively supported by the shock absorbing devices 2.

Further, when the recess portion 6 is formed as a result of one side of a rectangular-parallelepiped shape being hollowed out, the hollowed-out portion of the expanded polystyrene material should be scrapped. As a result, material yield is degraded.

IN addition, after the shock absorbing devices 2 have been used, that is, after the shock absorbing devices 2 have been removed from the electronic device 4 at a destination after transportation, the shock absorbing devices 2 should be stored or scrapped. However, because the shock absorbing devices 2 have large volumes, respectively, it is troublesome to store or scrap the shock absorbing devices 2.

SUMMARY OF THE INVENTION

The present invention is directed to eliminating the above-mentioned problems, and an object of the present invention is to provide a shock absorbing device which can positively support a to-be-shock-absorbed article, can be easily stored or scrapped, and also, is inexpensive.

A shock absorbing device, according to the present invention, comprises:

a first arm portion made of resin having a shock absorbing function; and a second arm portion made of resin having a shock absorbing function, and jointed with the first arm portion at, at least two positions, wherein:

the first arm portion comprises at least one deformation portion;

the second arm portion comprises at least one deformation portion; and a fitting space is formed between the first and second arm portions as a result of the deformation portions being deformed, a to-be-shock-absorbed article being held in the fitting space.

In this arrangement, the first and second arm portions are jointed at, at least two positions, and are movable with respect to one another. Each of the first and second arm portions has at least one deformation portion formed therein, and each of the first and second arm portions is deformable as a result of the deformation portion being deformed. Then, as a result of the deformation portions being deformed, the fitting space is formed between the first and second arm portions, the to-be-shock-absorbed article being able to be held in the fitting space.

In this shock absorbing device, because the to-be-shock-absorbed article is held in the fitting space formed by the first and second arm portions made of the resin having the shock absorbing function in a state in which the shock absorbing device has been deformed, the to-be-shock-absorbed article can be positively protected.

Further, in a state in which the shock absorbing device has not been deformed, the first and second arm portions are in proximity of one another, and thereby, the volume of the entire shock absorbing device is small. As a result, it is possible to improve material yield at the time of manufacturing the shock absorbing device.

Further, after the shock absorbing device is used, the volume of the entire shock absorbing device can be reduced, as a result of the first and second arm portions being returned to the state in which the first and second arm portions are in proximity of one another. As a result, storage or scrapping of the shock absorbing device can be easily performed.

The first and second arm portions may form the fitting space so as to surround the to-be-shock-absorbed article in said fitting space.

In this arrangement, the fitting space is such as that enclosed by a closed loop. As a result of each end of the to-be-shock-absorbed article being inserted into the fitting space, each end of the to-be-shock-absorbed article can be surrounded by the shock absorbing device. Thereby, the to-be-shock-absorbed article can be positively protected.

The deformation portions may comprise first and second V-shaped grooves and M-shaped slits;

the first V-shaped groove may be formed at an approximate center of the first arm portion;

the second V-shaped groove may be formed at an approximate center of the second arm portion;

each of the M-shaped slits may be formed at a respective one of portions at which the first and second arm portions are jointed; and each of the first and second V-shaped grooves may narrow and each of the M-shaped slits may widen when the first and second arm portions are moved to be apart from one anther so that the fitting space of a rectangular shape is formed between the first and second arm portions.

In this arrangement, as a result of each of the first and second V-shaped grooves narrowing and each of the M-shaped slits widening when the first and second arm portions are moved to be apart from one anther so that the fitting space is formed between the first and second arm portions, the fitting space has a shape of a rectangle. Generally speaking, in many cases, a shape of a to-be-shock-absorbed article is a rectangular parallelepiped. Therefore, as a result of the shock absorbing device having the rectangular fitting space, the shock absorbing device can be easily fitted into such a to-be-shock-absorbed article, and the to-be-shock-absorbed article can be positively held by the shock absorbing device.

The deformation portions may cause, as a result of being deformed, the first and second arm portions to move in directions of a plane of a slit which is formed between the first and second arm portions.

In this arrangement, because the first and second arm portions move in the directions of the plane of the slit, which is formed between the first and second arm portions, so as to be apart from one another, the fitting space is such as that enclosed by an open loop. Therefore, the shock absorbing device can be disposed so as to hold each corner of a to-be-shock-absorbed article, for example, having a rectangular-parallelepiped shape.

The deformation portions may comprise first, second, third, fourth, fifth and sixth V-shaped grooves;

the first V-shaped groove may be formed at an approximate center of a first surface of the first arm portion, and the second and third V-shaped grooves may be formed at two sides on a second surface of the first arm portion, the second surface being opposite to the first surface; and the fourth V-shaped groove may be formed at an approximate center of a first surface of the second arm portion, and the fifth and sixth V-shaped grooves may be formed at two sides on a second surface of the second arm portion, the second surface being opposite to the first surface.

the first surface of the first arm portion and the second surface of the second arm portion face in a first direction, and the second surface of the first arm portion and the first surface of the second arm portion face in a second direction opposite to the first direction; and each of the V-shaped grooves narrows when the shock absorbing device is deformed.

In this arrangement, as a result of each of the first through sixth V-shaped grooves being deformed so as to narrow, the fitting space formed by the first and second arm portions has a shape of a corner of a rectangular parallelepiped. Generally speaking, in many cases, a shape of a to-be-shock-absorbed article is a rectangular parallelepiped. Therefore, as a result of the fitting space having a shape of a corner of a rectangular parallelepiped, the shock absorbing device can be easily fitted to such a to-be-shock-absorbed article, and the to-be-shock-absorbed article can be positively protected.

Any one of the first and second arm portions may be separated at an approximate center thereof. Thereby, it is possible to reduce the bending forces to be applied to the deformation portions. Thereby, it is possible to prevent excess stresses from being applied to the deformation portions.

Other objects and further features of the present invention will become more apparent from the following detailed descriptions when read in conjunction with the accompanying drawings.

DETAILED DESCRIPTION OF THE PREFERRED EMBODIMENTS

Embodiments of the present invention will now be described with reference to figures.

Figure 1:
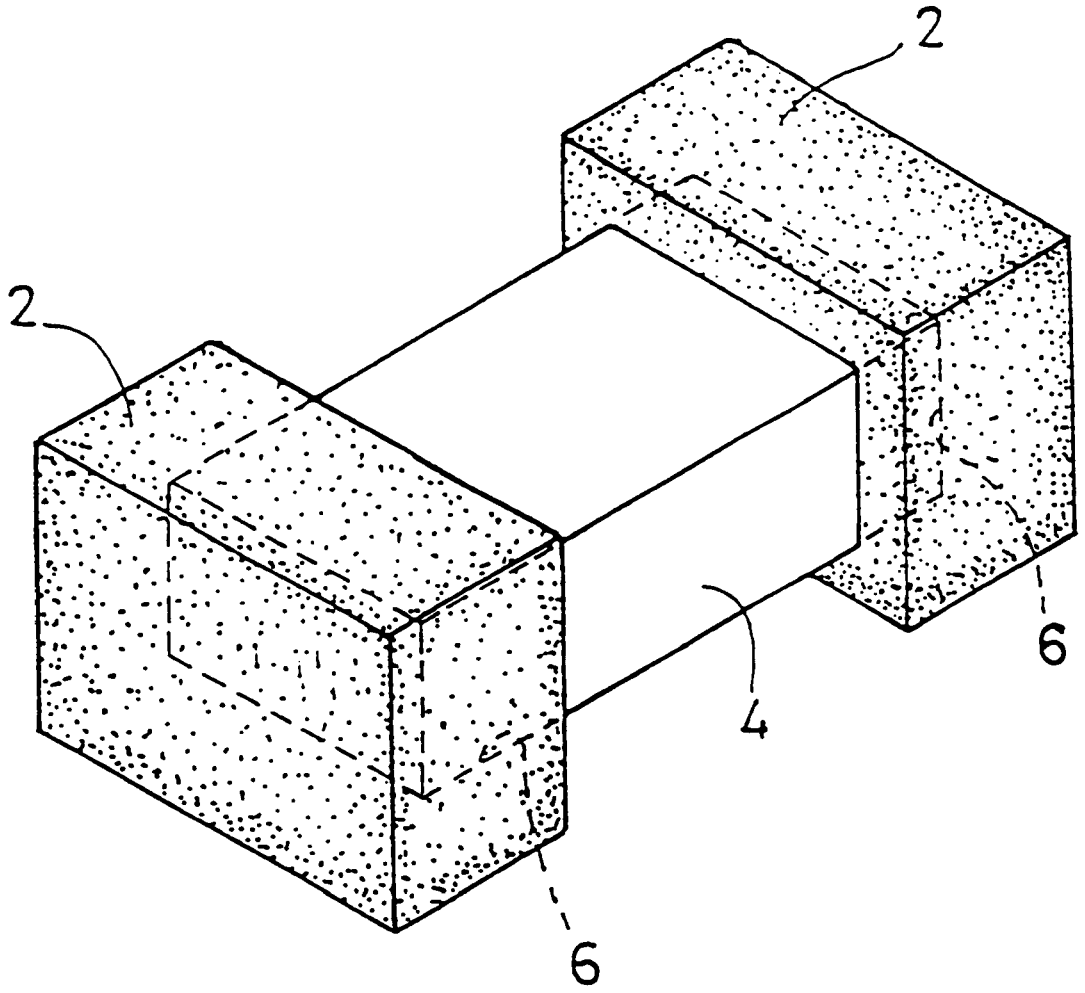
FIG. 1 shows a perspective view of one example of shock absorbing devices in the related art.
Figure 2:
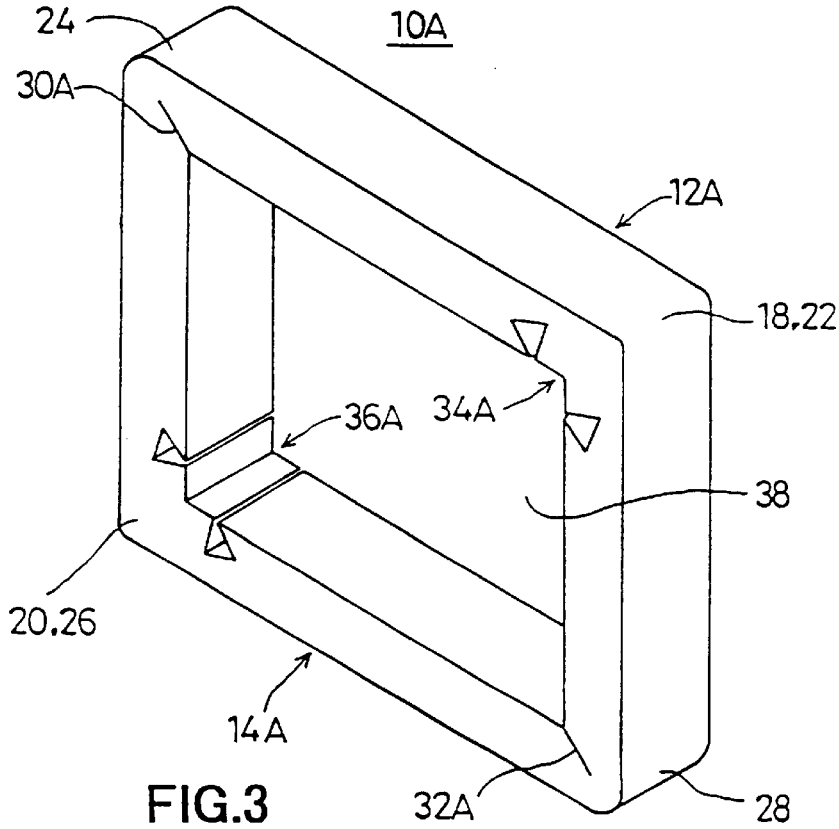
FIG. 2 shows a perspective view of a shock absorbing device in a first embodiment of the present invention in a state in which the shock absorbing device has been deformed.
Figure 3:
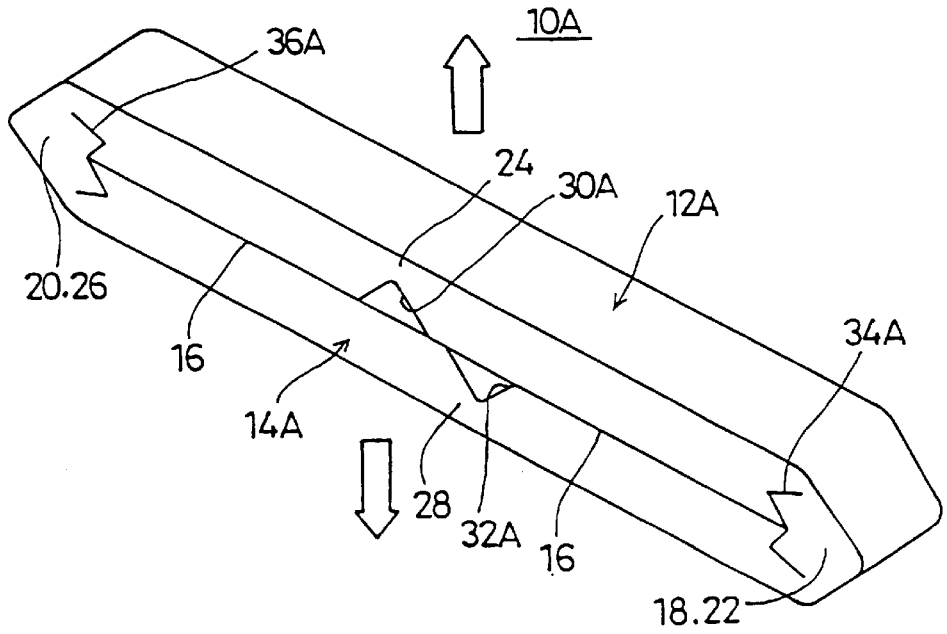
FIG. 3 shows a perspective view of the shock absorbing device in the first embodiment of the present invention in a state in which the shock absorbing device has not been deformed.

FIGS. 2 and 3 show a shock absorbing device 10A in a first embodiment of the present invention. FIG. 2 shows a state of the shock absorbing device 10A when the shock absorbing device 10A has been deformed. FIG. 3 shows a state of the shock absorbing device 10A when the shock absorbing device 10A has not been deformed.

Generally, the shock absorbing device 10A includes a first arm portion 12A and a second arm portion 14A. The first arm portion 12A and second arm portion 14A are jointed at junction portions 18 and 20 at the two ends of each of the first and second arm portions 12A and 14A. Thus, the first and second arm portions 12A and 14A are integrated.

The first and second arm portions 12A and 14A are made of resin such as cellular polyurethane, cellular polyethylene or the like. Each of cellular polyurethane and cellular polyethylene has elasticity higher than expanded polystyrene. Therefore, the first and second arm portions 12A and 14A can be elastically deformed, and have a shock absorbing function.

Further, as shown in FIG. 3, a slit 16 is formed between the first and second arm portions 12A and 14A through a range from the junction portion 18 to the junction portion 20. Thus, the first and second arm portions 12A and 14A are defined (that is, separated) from one another by the slit 16 between the pair of the junction portions 18 and 20.

Further, as shown in FIG. 3, V-shaped grooves 30A and 32A are formed at an approximate center of the first arm portion 12A and at an approximate center of the second arm portion 14A on the surfaces thereof on which the first and second arm portions 12A and 14A face one another via the slit 16. Further, M-shaped slits 34A and 36A are formed at the junction portions 18 and 20, respectively, where the slit 16 continues to the M-shaped slits 34A and 36A, respectively, as shown in the figure.

As a result of the V-shaped grooves 30A and 32A and M-shaped slits 34A and 36A being formed in the first and second arm portions 12A and 14A, portions at which the V-shaped grooves 30A and 32A and the M-shaped slits 34A and 36A are formed are likely to be deformed. These portions of the first and second arm portions 12A and 14A which are thus likely to be deformed as a result of the V-shaped grooves 30A and 32A and M-shaped slits 34A and 36A being formed will be referred to as deformation portions 24, 28, 22 and 26.

A manufacturing method of the above-described shock absorbing device 10A will now be described with reference to FIG. 4. In order to form the shock absorbing devices 10A, a board 50 made of cellular polyurethane, cellular polyethylene or the like is prepared. Then, a punch die (not shown in the figure) is used and blanking or stamping is performed on the board 50. Thus, a plurality of shock absorbing devices 10A, in the state in which the shock absorbing devices 10A have not been deformed, as shown in FIG. 3, are formed at the same time.

As a result of forming the plurality of shock absorbing devices 10A at the same time using the punch die, it is possible to improve manufacturing efficiency, and thus, to reduce the costs of the shock absorbing devices 10A. Further, by forming the shock absorbing devices 10A in the state at which the shock absorbing devices 10A have not been deformed, and appropriately selecting portions to be blanked or stamped (indicated by dotted areas in FIG. 4) from the board 50, it is possible to minimize portions of the board 50 to be scrapped. As a result, it is possible to improve material yield, and thus, further reduce the costs of the shock absorbing devices 10A.

When the shock absorbing device 10A is manufactured, dimensions of respective elements of the shock absorbing device 10A are set as follows: The thickness of the first arm portion 12A and the thickness of the second arm portion 14A are the same as each other and each thickness is a dimension 'a', as shown in FIG. 4.

Figure 4:
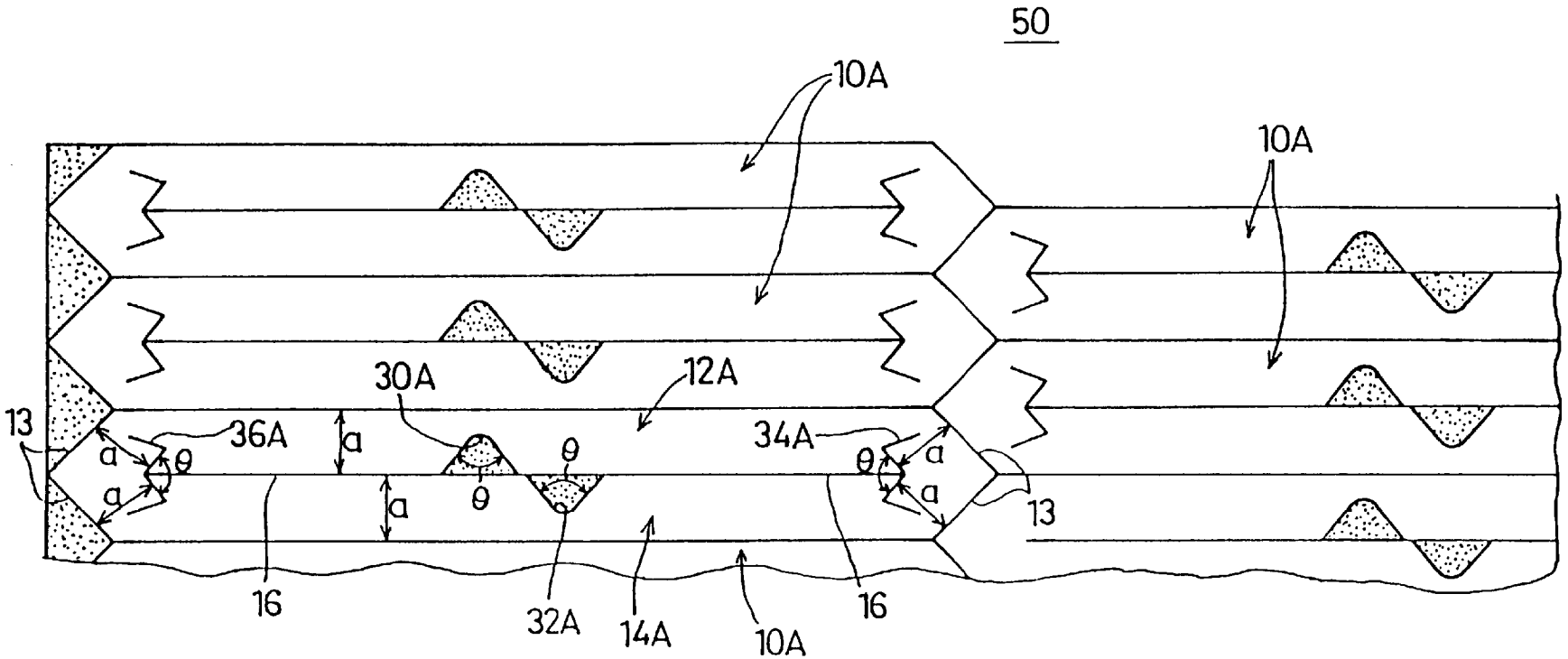
FIG. 4 illustrates a manufacturing method of the shock absorbing devices in the first embodiment of the present invention.

Further, each of the distances between the inside sides of each of the M-shape slits 34A and 36A and the outer sides 13 of the first and second arm portions 12A and 14A which face the inside sides of the M-shape slit, respectively, is the dimension 'a' as shown in FIG. 4. Further, each of these inside sides is parallel to a respective one of the outer sides 13. Further, each of an angle θ of each of the V-shape grooves 30A and 30B and an angle θ of the center of each of the M-shape slits 34A and 36A is set to approximately 90 degrees, as shown in the figure.

With reference to FIGS. 2, 3, 5 and 6, a method for fitting the shock absorbing device 10A to a to-be-shock-absorbed article 40 (that is, an article in which a shock applied thereto is absorbed by the shock absorbing devices 10A).

In order to fit the shock absorbing device 10A to the to-be-shock-absorbed article 40, the shock absorbing device 10A in the state in which the shock absorbing device 10A has not been deformed, shown in FIG. 3, is deformed so that the first and second arm portions 12A and 14A are apart from one another in directions perpendicular to the plane of the slit 16 as indicated by arrows shown in FIG. 3.

As mentioned above, the first and second arm portions 12A and 14A are jointed at the junction portions 18 and 20 at the two ends of the first and second arm portions 12A and 14A. As shown in FIG. 3, the slit 16 is formed between the first and second arm portions 12A and 14A except the junction portions 18 and 20. As a result, the first and second arm portions 12A and 14A are movable with respect to one another. Further, as mentioned above, as a result of the V-shaped grooves 30A and 32A and M-shaped slits 34A and 36A being formed in the first and second arm portions 12A and 14A, the easily deformable deformation portions 24, 28, 22 and 26 are formed.

Therefore, when the first and second arm portions 12A and 14A are moved in directions such as to be apart from one another as mentioned above, the respective deformation portions 24, 28, 22 and 26 are deformed. As a result, as shown in FIG. 2, a fitting space 38 is formed between the first and second arm portion 12A and 14A.

At this time, because the first and second arm portions 12A and 14A are apart from one another in directions such that the slit 16 is widened, and also, the two ends of the first and second arm portions 12A and 14A are jointed at the junction portions 18 and 20, the thus-formed fitting space 38 is such as that enclosed by a closed loop. Further, as a result of the first and second arm portions 12A and 14A being thus moved, each of the V-shape grooves 30A and 32A narrows, and, and each of the M-shape slits 34A and 36A widens. Further, because each of the angle θ of each of the V-shaped grooves 30A and 32A and the angle θ of the center of each of the M-shaped slits 34A and 36A is set to approximately 90 degrees, the fitting space 38 formed by the first and second arm portions 12A and 14A has a rectangular shape.

Figure 5:
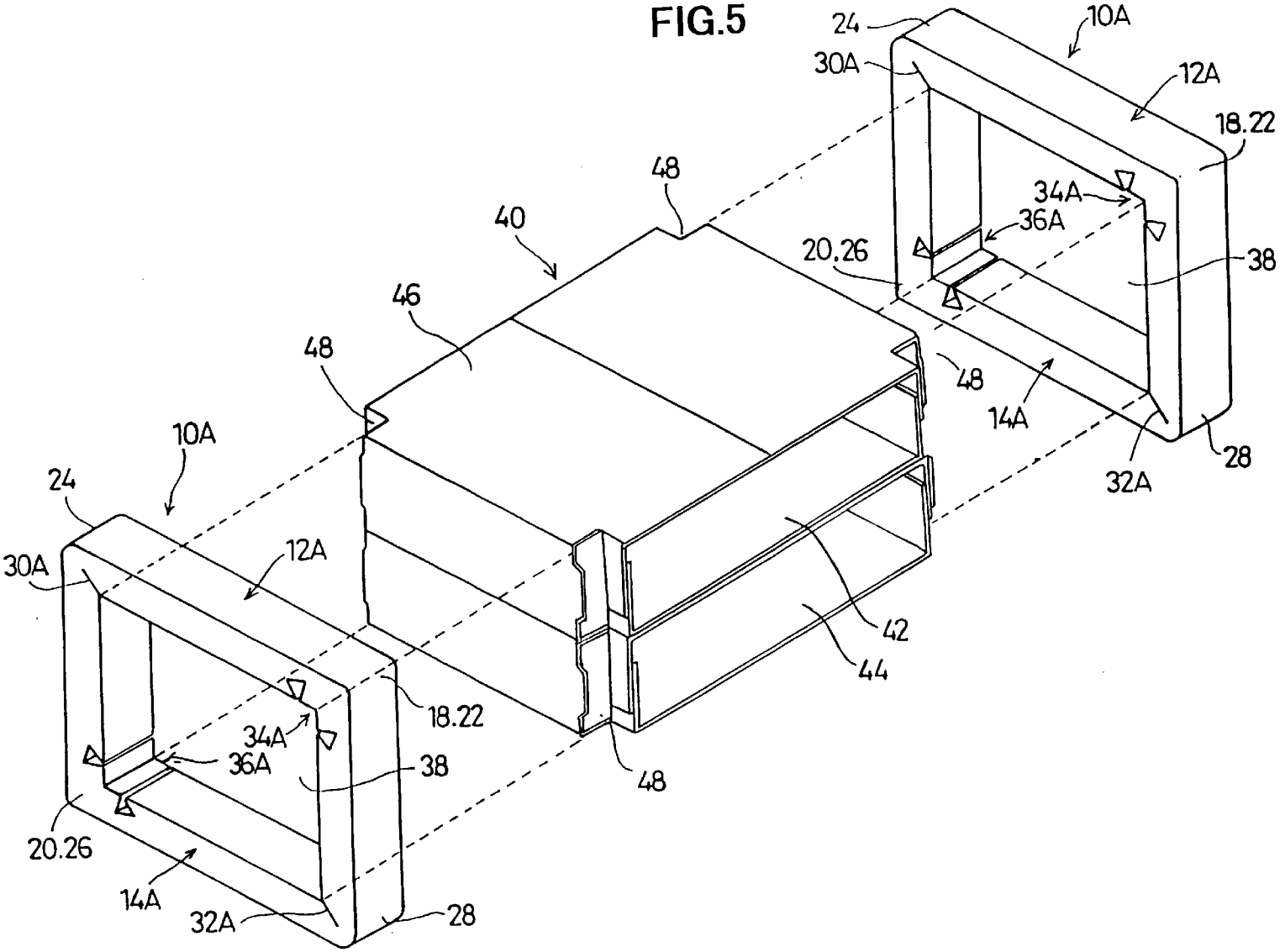
FIG. 5 shows a perspective view indicating a manner for fitting the shock absorbing devices in the first embodiment of the present invention to a to-be-shock-absorbed article.
Figure 6:
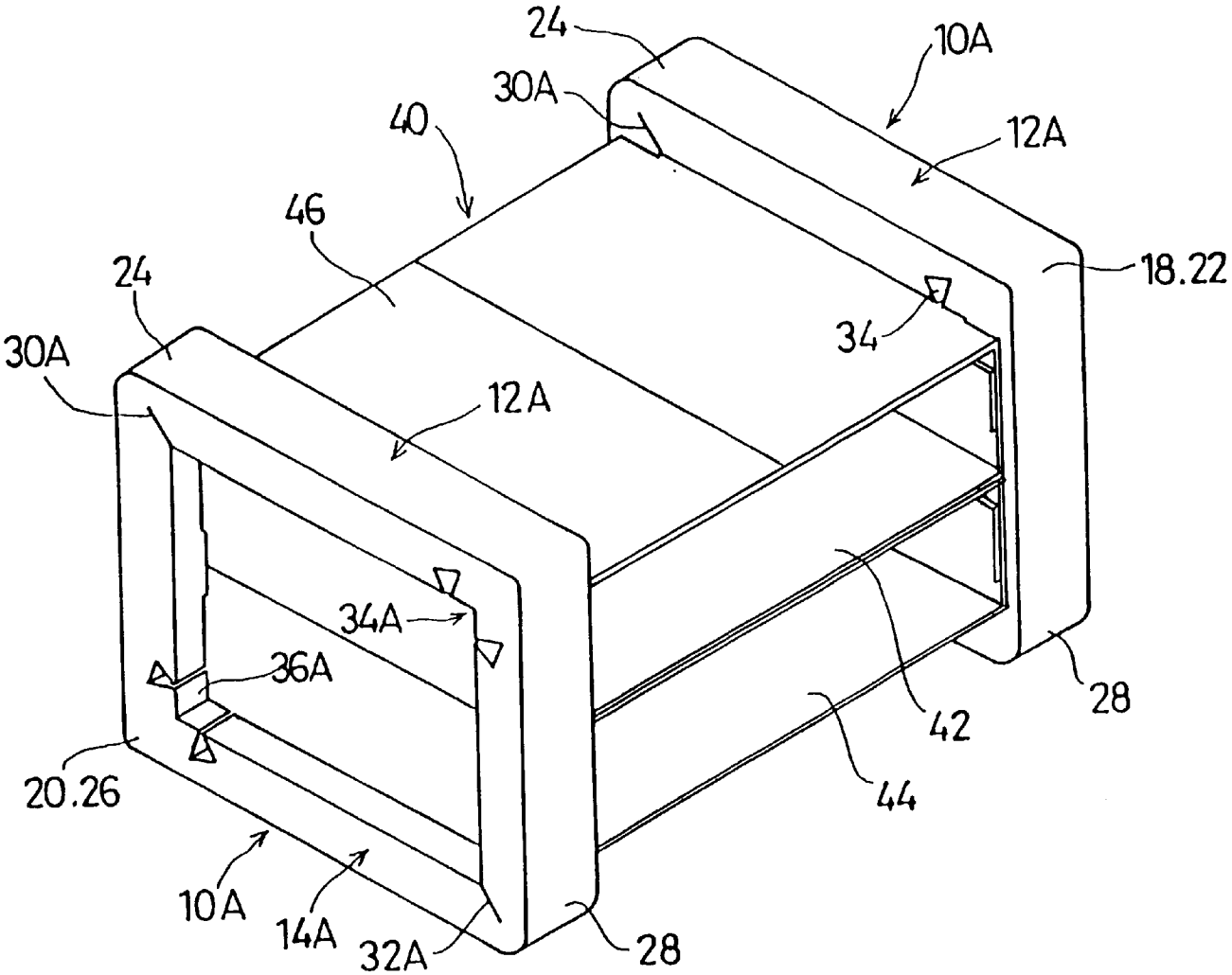
FIG. 6 shows a perspective view indicating a state in which the shock absorbing devices in the first embodiment of the present invention have been fitted to the to-be-shock-absorbed article.

After the shock absorbing device 10A enters the deformed state, shown in FIG. 2, as a result of the above-mentioned operation being performed, the shock absorbing device 10A is fitted to the to-be-shock-absorbed article 40. As shown in FIGS. 5 and 6, two electronic devices 42 and 44 are placed one upon another, are packed by thick packing paper 46, and then, comprise the to-be-shock-absorbing article 40.

Thus, when the electric devices 42 and 44 are shipped, the electronic devices 42 and 44 are packed by thick packing paper 46, and the shock absorbing devices 10A are fitted to the electronic devices which have been packed by the thick packing paper 46. Thus, the electronic devices 42 and 44 are positively protected from an external shock or the like. Further, step portions 48 are provided at the corners of the to-be-shock-absorbed article 40, and the shock absorbing devices 10 are fitted to the step portions 48.

When the to-be-shock-absorbed article 40 is fitted to the shock absorbing device 10A, the step portions 48 of the to-be-shock-absorbed article 40 is pressed and fitted into the fitting space 38 of the shock absorbing device 10A. As a result, the shock absorbing device 10A surrounds the to-be-shock-absorbed article 40, and can positively protect the to-be-shock-absorbed article 40.

Further, generally speaking, in many case, a to-be-shock-absorbed article has a rectangular-parallelepiped external shape. Therefore, by forming the shock absorbing device 10A so as to have the rectangular fitting space 38 as a result of appropriately setting the shapes of the V-shape grooves 30A and 32A and M-shape slits 34A and 36A, fitting of the to-be-shock-absorbed article into the shock absorbing device 10A can be easily performed, and protection of the to-be-shock-absorbed article can be positively performed.

Further, because the fitting space 38 is formed as a result of the first and second arm portions 12A and 14A being deformed, and not as a result of hollowing-out processing being performed as in the related art, it is possible to improve material yield.

Further, in the respective deformation portions 24, 28, 22 and 26 of the shock absorbing device 10A in the deformed state shown in FIG. 2, elastic restoration forces are exerted such as to cause the shock absorbing device 10A to return to the state, shown in FIG. 3, in which the shock absorbing device 10A has not been deformed. Thereby, in the state in which the shock absorbing device 10A has been fitted to the to-be-shock-absorbed article 40, the elastic restoration forces are exerted as forces such as to cause the first and second arm portions 12A and 14A to be pressed onto the to-be-shock-absorbed article 40. Thereby, the shock absorbing device 10A is positively fitted to the to-be-shock-absorbed article 40, and thus, the slipping off of the shock absorbing device 10A from the to-be-shock-absorbed article 40 can be prevented.

After the shock absorbing devices 10A have been fitted to the to-be-shock-absorbed article 40 as shown in FIG. 6, the to-be-shock-absorbed article 40 is loaded in a corrugated carton (not shown in the figures) together with the shock absorbing device 10A, and is shipped. Because the shock absorbing devices 10A are positively fitted to the to-be-shock-absorbed article 40 as mentioned above, the electronic devices 42 and 44 are positively protected. Further, as a result of the deformation portions 24 and 28 being deformed, the blanked or stamped surfaces of each of the V-shape grooves 30A and 32A come into contact with each other. Thus, the blanked or stamped surfaces support one another.

Then, after the electronic devices 42 and 44 are removed from the shock absorbing devices 10A at a destination of transportation (hereinafter, referred to as 'after being used'), the shock absorbing devices 10A are managed as described below.

After being used, the shock absorbing device 10A should be stored or scrapped. Because the shock absorbing device 2 in the related art cannot be deformed, the shock absorbing device 2 maintains the large volume after being used. Therefore, storage or scrapping of the shock absorbing device 2 is troublesome as mentioned above.

In contrast to this, the deformation portions 24, 28, 22 and 26 of the shock absorbing device 10A can be deformed to the state in which the deformation portions 24, 28, 22 and 26 have not been deformed, that is, the shock absorbing device 10A can be returned to the state shown in FIG. 3. In this undeformed state shown in FIG. 3, the total volume of the shock absorbing device 10A is small, and, therefore, storage or scrapping of the shock absorbing device 10A can be easily performed.

A second embodiment of the present invention will now be described.

Figure 7:
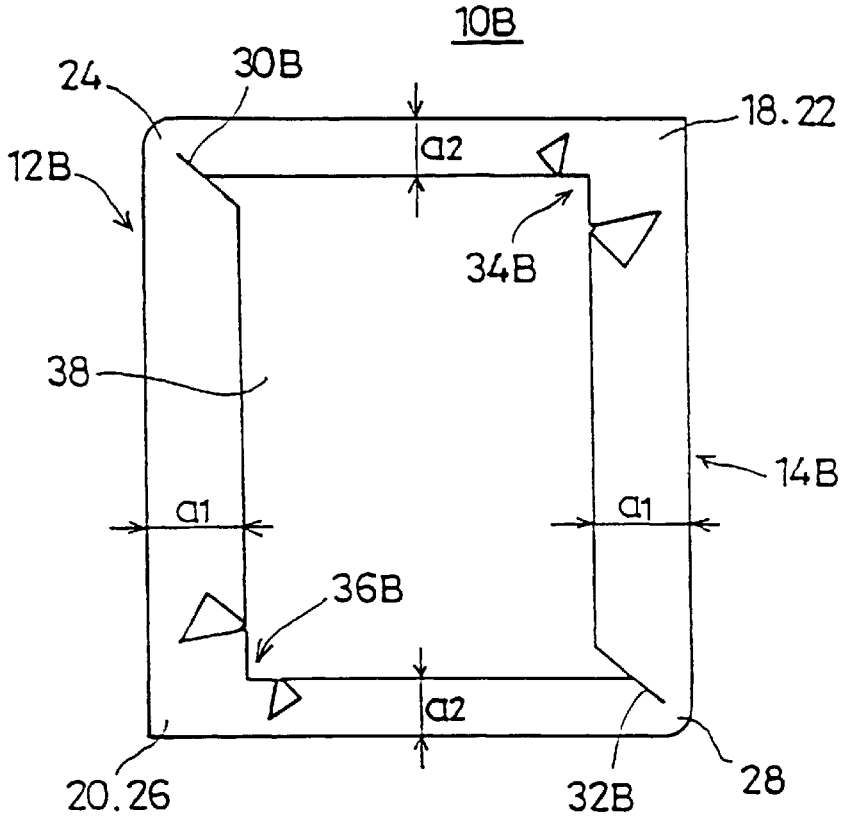
FIG. 7 shows a plan view of a shock absorbing device in a second embodiment of the present invention in a state in which the shock absorbing device has been deformed.
Figure 8:
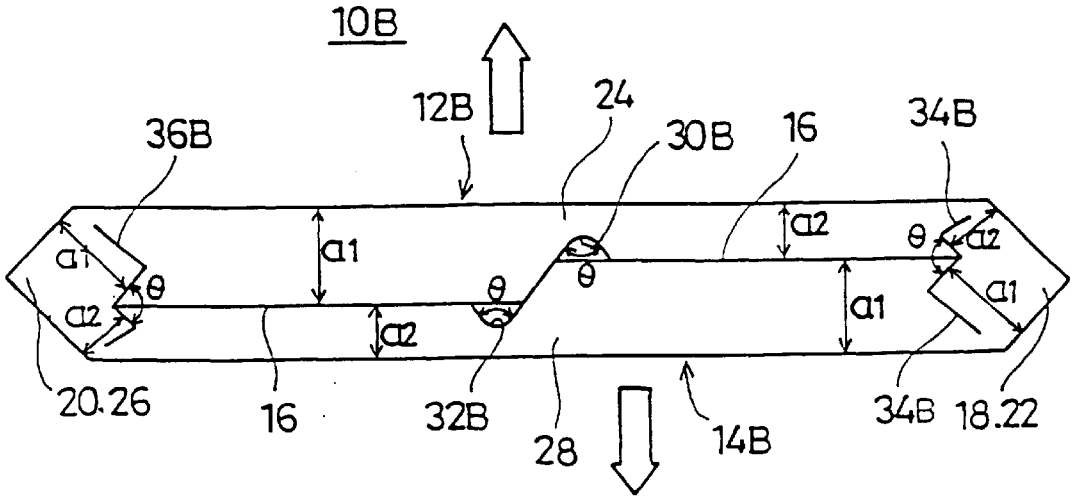
FIG. 8 shows a plan view of the shock absorbing device in the second embodiment of the present invention in a state in which the shock absorbing device has not been deformed.

FIGS. 7 and 8 show a shock absorbing device 10B in the second embodiment of the present invention. FIG. 7 shows a state in which the shock absorbing device 10B has been deformed. FIG. 8 shows a state in which the shock absorbing device 10B has not been deformed. In FIGS. 7 and 8, the same reference numerals are given to portions the same as those of the shock absorbing device 10A in the first embodiment described with reference to FIGS. 2, 3, 4, 5 and 6, and a description thereof will be omitted.

In the shock absorbing device 10A in the first embodiment, the width dimensions of the first and second arm portions 12A and 14A are the equal dimension 'a'. However, a shape of a to-be-shock-absorbed article varies. A local projection may be provided on a to-be-shock-absorbed article. There is a case where the shock absorbing device 10A in which the first and second arm portions 12A and 14A have the equal width dimension cannot be used for a to-be-shock-absorbed article having a complicated shape.

Therefore, in the shock absorbing device 10B in the second embodiment, first and second arm portions 12B and 14B do not have an equal width dimension. Specifically, as shown in FIG. 8, the width dimension of the first arm portion 12B on the left side of a V-shape groove 30B is 'a1' while the width dimension of the first arm portion 12B on the right side of the V-shape groove 30B is 'a2' smaller than 'a1 (a1>a2). The width dimension of the second arm portion 14B on the right side of a V-shape groove 32B is 'a1' while the width dimension of the second arm portion 14B on the left side of the V-shape groove 32B is 'a2' smaller than a1 (a1>a2).

Figure 9:
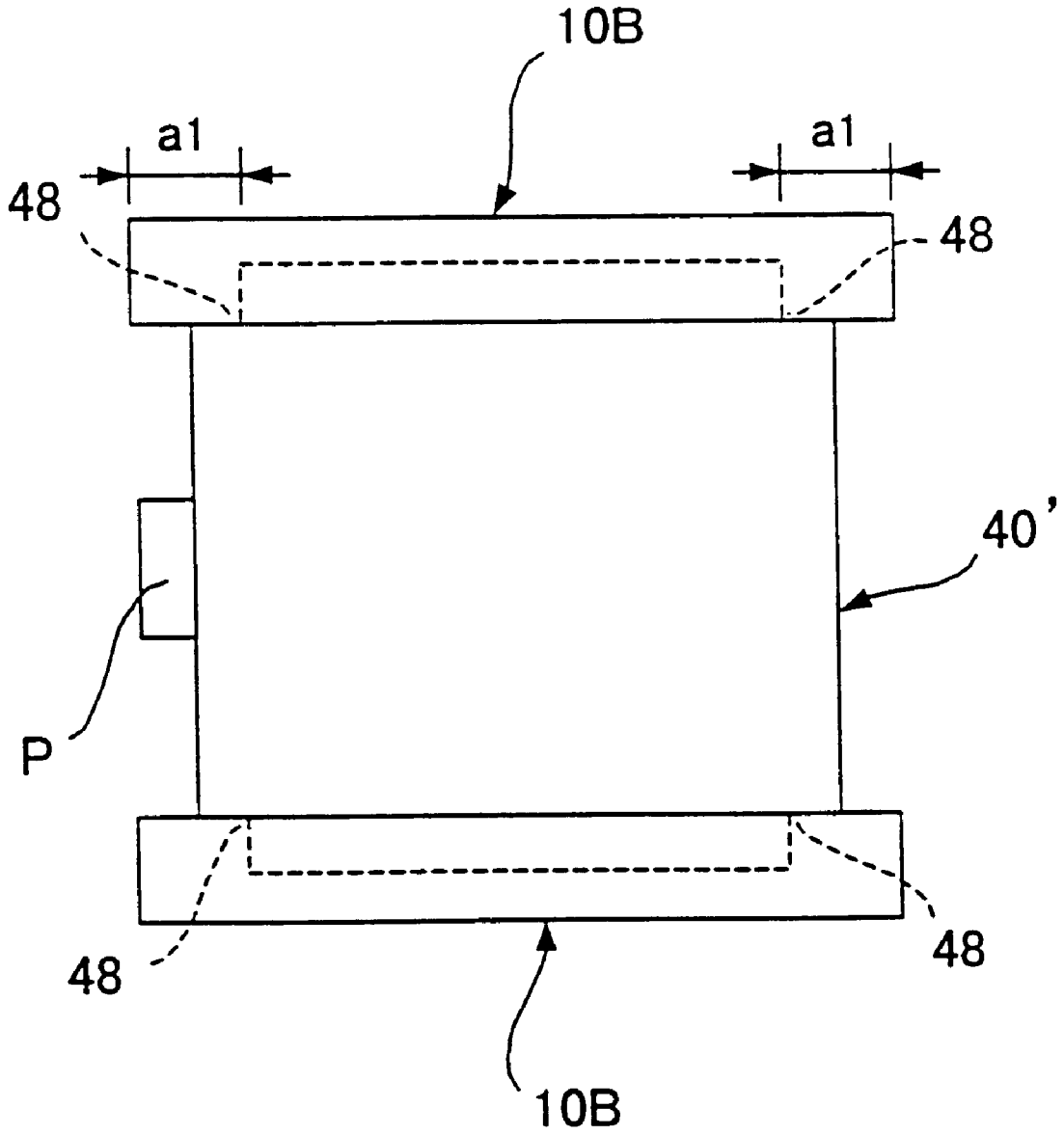
FIG. 9 shows a state in which the shock absorbing devices in the second embodiment of the present invention have been fitted to a to-be-shock-absorbed article having a local projection provided thereto.

In this structure, in the state shown in FIG. 7 in which the shock absorbing device 10B has been deformed, the respective sides of the rectangular shape of the shock absorbing device 10B have the different thicknesses (a1 and a2). Thereby, when the shock absorbing device 10B is fitted to a to-be-shock-absorbed article 40' having a local projection P, as shown in FIG. 9, it is possible to prevent the projection P from sticking out from the shock absorbing device 10B, as a result of aligning the projection P to the portion of the shock absorbing devices 10B having the large width dimension ('a1'), Thus, it is possible to perform the shock absorbing function on the to-be-shock-absorbed article 40' having the projection P.

A third embodiment of the present invention will now be described.

Figure 10A:
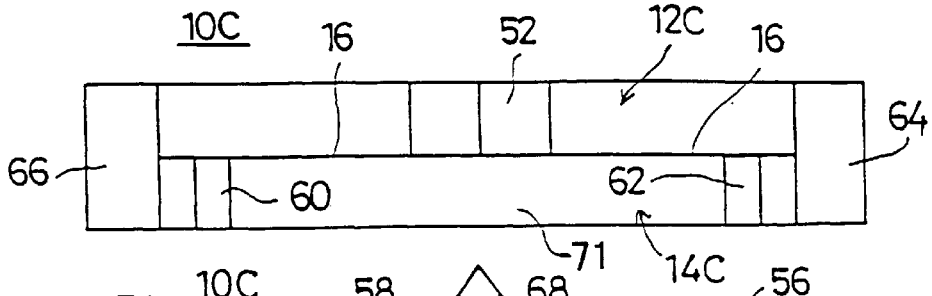
FIG. 10A shows a front elevational view of a shock absorbing device in a third embodiment of the present invention.
Figure 10B:
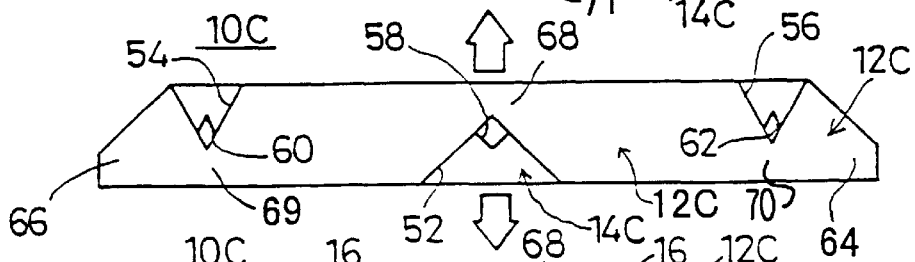
FIG. 10B shows a plan view of the shock absorbing device.
Figure 10C:
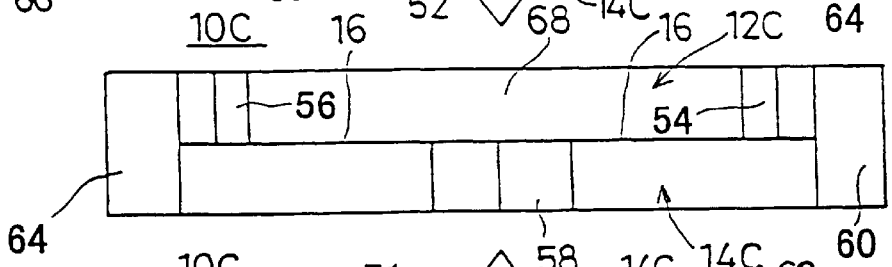
FIG. 10C shows a rear elevational view of the shock absorbing device.
Figure 10D:
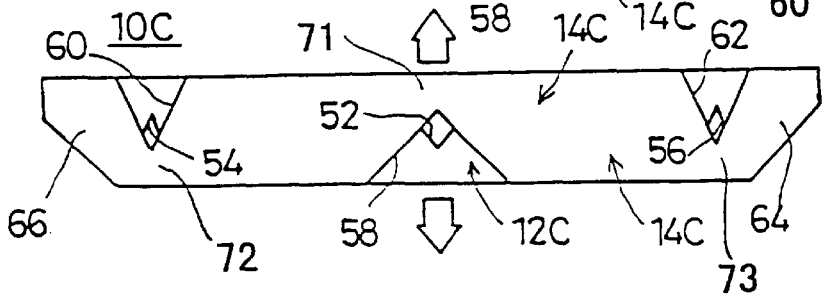
FIG. 10D shows a bottom view of the shock absorbing device.
Figure 11:
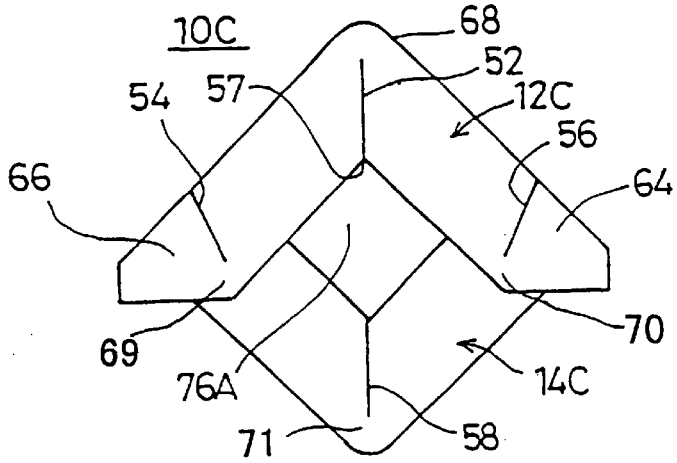
FIG. 11 shows a plan view of the shock absorbing device in the third embodiment of the present invention in a state in which the shock absorbing device has been deformed.

FIGS. 10A, 10B, 10C, 10D and 11 show a shock absorbing device 10C in the third embodiment. FIGS. 10A, 10B, 10C and 10D show a state in which the shock absorbing device 10C has not been deformed. FIG. 11 shows a state in which the shock absorbing device 10C has been deformed. In FIGS. 10A, 10B, 10C, 10D and 11, the same reference numerals are given to portions the same as those of the shock absorbing device 10A in the first embodiment described with reference to FIGS. 2, 3, 4, 5 and 6, and a description thereof will be omitted.

Generally, also, the shock absorbing device 10C includes a first arm portion 12C and a second arm portion 14C. The first arm portion 12C and second arm portion 14C are jointed at junction portions 64 and 66 at the two ends of each of the first and second arm portions 12C and 14C. Thus, the first and second arm portions 12C and 14C are integrated. Similar to the first and second embodiments, the first and second arm portions 12C and 14C are made of resin such as cellular polyurethane, cellular polyethylene or the like. As a result, the first and second arm portions 12C and 14C can be elastically deformed, and have a shock absorbing function.

Further, as shown in FIGS. 10A and 10C, a slit 16 is formed between the first and second arm portions 12C and 14C through a range from the junction portion 64 to the junction portion 66. Thus, the first and second arm portions 12C and 14C are defined (that is, separated) from one another by the slit 16 between the pair of the junction portions 64 and 66.

A V-shaped groove 52 is formed at an approximate center on the front surface of the first arm portion 12C, as shown in FIGS. 10A and 10B. V-shaped grooves 54 and 56 are formed at two sides on the rear surface of the first arm portion 12C, as shown in FIGS. 10B and 10C. A V-shaped groove 58 is formed at an approximate center on the rear surface of the second arm portion 14C, as shown in FIGS. 10C and 10D. V-shaped grooves 60 and 62 are formed at two sides on the front surface of the second arm portion 14C, as shown in FIGS. 10A and 10D.

As a result of the V-shaped grooves 52, 54, 56, 58, 60 and 62 being formed in the first and second arm portions 12C and 14C, portions at which the V-shaped grooves 52, 54, 56, 58, 60 and 62 are formed are likely to be deformed. These portions of the first and second arm portions 12C and 14C which are thus likely to be deformed as a result of the V-shaped grooves 52, 54, 56, 58, 60 and 62 being formed will be referred to as deformation portions 68, 69, 60, 71, 72 and 73.

A method for fitting the shock absorbing device 10C to a to-be-shock-absorbed article will now be described.

In order to fit the shock absorbing device 10C to a to-be-shock-absorbed article, the first and second arm portions 12C and 14C, in the state in which the shock absorbing device 10C has not been deformed, as shown in FIGS. 10A, 10B, 10C and 10D, are moved in directions of the plane of the slit 16, indicated by arrows shown in FIGS. 10B and 10D, such as to be apart from one another.

As mentioned above, the first and second arm portions 12C and 14C are jointed at the junction portions 64 and 66 at the two ends of the first and second arm portions 12C and 14C. The slit 16 is formed between the first and second arm portions 12C and 14C except the junction portions 64 and 66. As a result, the first and second arm portions 12C and 14C are movable with respect to one another. Further, as mentioned above, as a result of the V-shaped grooves 52, 54, 56, 58, 60 and 62 being formed in the first and second arm portions 12C and 14C, the deformation portions 68, 69, 70, 71, 72 and 73, which can be easily deformed in directions of the plane of the slit 16, are formed.

Therefore, when the first and second arm portions 12C and 14C are moved in directions of the plane of the slit 16, such as to be apart from one another as mentioned above, a fitting space 76A is formed between the first and second arm portions 12C and 14C.

At this time, the first and second arm portions 12C and 14C have L shapes (projecting in the directions opposite to one another), respectively, and are placed upon one another on the front side and on the rear side in FIG. 11. The fitting space 76A formed by the first and second arm portions 12C and 14C has a shape, having an angular portion 57, enclosed by an open loop, which shape is suitable for being fitted to each corner (vertex) of a to-be-shock-absorbed article having a rectangular-parallelepiped shape.

Generally speaking, in many cases, a shape of a to-be-shock-absorbed article is a rectangular parallelepiped. In such a case, each corner of an article is a shape of a vertex of a rectangular parallelepiped. As a result of the fitting space 76A of the shock absorbing device 10C having a shape enclosed by a closed loop having an angular portion 57, the shock absorbing device 10C can positively protect each corner of such a to-be-shock-absorbed article. When the shock absorbing device 10C is applied to an article having a rectangular-parallelepiped shape, a total of eight shock absorbing devices 10C are used for the respective corners (vertexes) of the rectangular parallelepiped.

A fourth embodiment of the present invention will now be described.

Figure 12A:
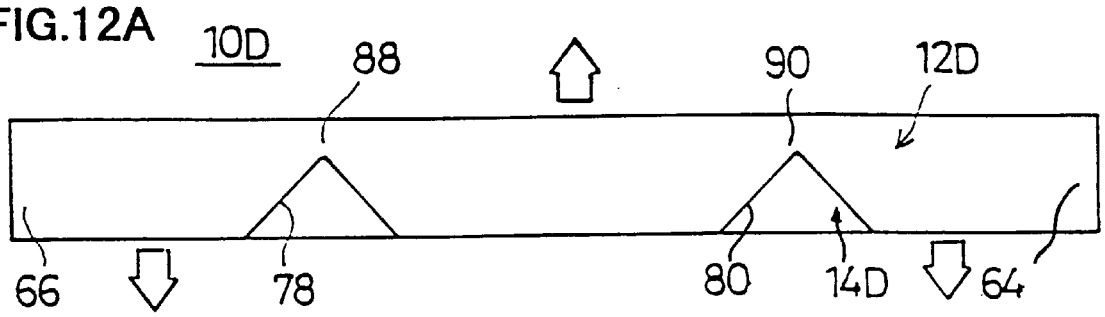
FIG. 12A shows a plan view of a shock absorbing device in a fourth embodiment of the present invention.
Figure 12B:
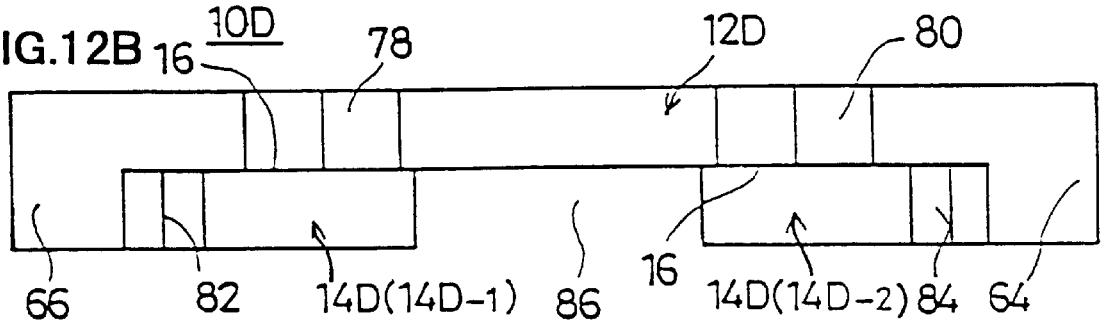
FIG. 12B shows a front elevational view of the shock absorbing device.
Figure 12C:
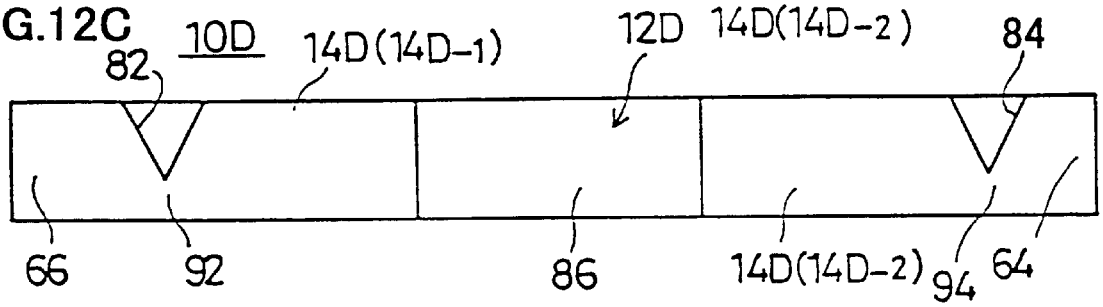
FIG. 12C shows a bottom view of the shock absorbing device.
Figure 13:
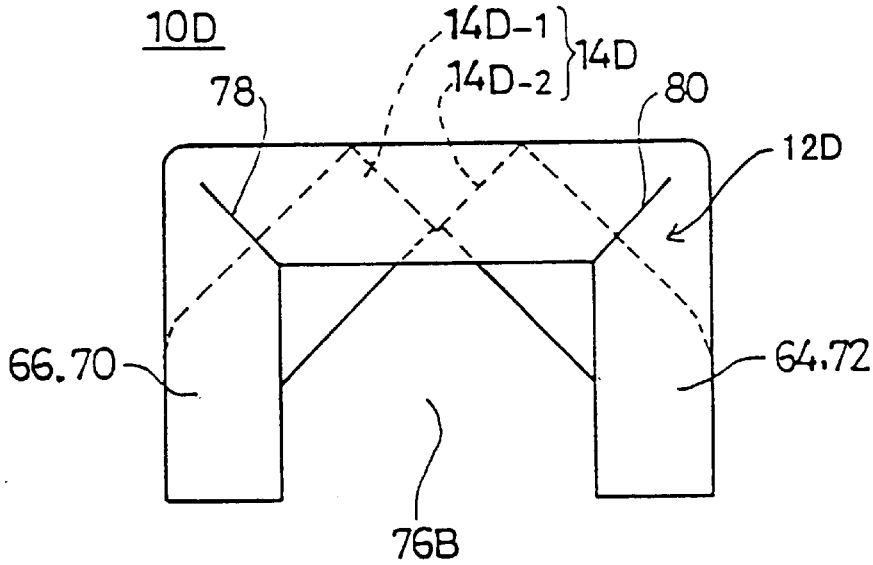
FIG. 13 shows a plan view of the shock absorbing device in the fourth embodiment of the present invention in a state in which the shock absorbing device has been deformed.

FIGS. 12A, 12B, 12C and 13 show a shock absorbing device 10D in the fourth embodiment. FIGS. 12A, 12B and 12C show a state in which the shock absorbing device 10D has not been deformed. FIG. 13 shows a state in which the shock absorbing device 10D has been deformed. In FIGS. 12A, 12B, 12C and 13, the same reference numerals are given to portions the same as those of the shock absorbing device 10C in the third embodiment described with reference to FIGS. 10A, 10B, 10C, 10D and 11, and a description thereof will be omitted.

Generally, also, the shock absorbing device 10D includes a first arm portion 12D and a second arm portion 14D. The first arm portion 12D and second arm portion 14D are jointed at junction portions 64 and 66 at the two ends of each of the first and second arm portions 12D and 14D. Thus, the first and second arm portions 12D and 14D are integrated. Similar to the first, second and third embodiments, the first and second arm portions 12D and 14D are made of resin such as cellular polyurethane, cellular polyethylene or the like. As a result, the first and second arm portions 12D and 14D can be elastically deformed, and have a shock absorbing function.

As shown in FIGS. 12A and 12B, V-shaped grooves 78 and 80 are formed at two sides on the front surface of the first arm portion 12D. Further, as shown in FIGS. 12B and 12C, V-shaped grooves 82 and 84 are formed at two sides on the front surface of the second arm portion 14D.

Further, as shown in FIGS. 12B and 12C, in the shock absorbing device 10D, a space 86 is formed at a center of the second arm portion 14D. By the space 86, the second arm portion 14D is separated at the center into arm portions 14D-1 and 14D-2.

As a result of the V-shaped grooves 78, 80, 82 and 84 being formed in the first and second arm portions 12D and 14D, portions at which the V-shaped grooves 78, 80, 82 and 84 are formed are likely to be deformed. These portions of the first and second arm portions 12D and 14D which are thus likely to be deformed as a result of the V-shaped grooves 78, 80, 82 and 84 being formed will be referred to as deformation portions 88, 90, 92 and 94.

Further, because the second arm portion 14D is separated into the arm portions 14D-1 and 14D-2 as a result of the space 86 being formed, different from the second arm portions 14A, 14B and 14C in the other embodiments, no excess bending stress is applied to the central portion of the second arm portion 14D when the second arm portion 14D is deformed.

A method for fitting the shock absorbing device 10D to a to-be-shock-absorbed article will now be described.

In order to fit the shock absorbing device 10D to a to-be-shock-absorbed article, the first and second arm portions 12D and 14D in the state in which the shock absorbing device 10D has not been deformed as shown in FIGS. 12A, 12B and 12C are moved in directions of the plane of the slit 16, indicated by arrows shown in FIG. 12A, such as to be apart from one another. Thereby, a fitting space 76B is formed between the first and second arm portions 12D and 14D.

At this time, the first arm portion 12D having an angular-C shape and the second arm portion 14D having an L shape, are placed upon one another on the front side and on the rear side in FIG. 13. The fitting space 76B formed by the first and second arm portions 12D and 14D has an angular-C shape, enclosed by an opened loop. As a result of fitting the shock absorbing device 10D in the thus-deformed state into a corner of a corrugated carton (not shown in the figure), the first and second arm portions 12D and 14D come into contact with inner walls of the corrugated carton, and thus, the deformed state of the shock absorbing device 10D is maintained. When the shock absorbing device 10D is applied to an article of a rectangular-parallelepiped shape, because the one shock absorbing device 10D protects two adjacent corners (vertexes) of the rectangular parallelepiped, a total of 4 shock absorbing devices 10D are used.

Further, the present invention is not limited to the above-described embodiments, and variations and modifications may be made without departing from the scope of the present invention.

The contents of the basic Japanese Patent Application No.9-242971, filed on Sep. 8, 1997, are hereby incorporated by reference.

What is claimed is:

1. A shock absorbing device comprising:

a first arm portion made of resin having a shock absorbing function; and a second arm portion made of resin having a shock absorbing function, and jointed with said first arm portion at, at least two positions, wherein:

said first arm portion comprises at least one deformation portion;

said second arm portion comprises at least one deformation portion; and a fitting space is formed between said first and second arm portions as a result of said deformation portions being deformed, a to-be-shock-absorber article being held in said fitting space, surrounded by said first and second arm portions;

wherein:

said deformation portions comprise first and second V-shaped grooves and M-shaped slits;

said first V-shaped groove is formed at an approximate center of said first arm portion;

said second V-shaped groove is formed at an approximate center of said second arm portion;

each of said M-shaped slits is formed at a respective one of portions at which said first and second arm portions are jointed; and each of said first and second V-shaped grooves narrows and each of said M-shaped slits widens when said first and second mark portions are moved to be apart from one another so that said fitting space of a rectangular shape is formed between said first and second arm portions.

2. A shock absorbing device comprising:

a first arm portion made of resin having a shock absorbing function;

a second arm portion made of resin having a shock absorbing function, and joined with said first arm portion at, at least two positions, a first slit being formed between said first and second arm portions other than the joined positions such as to render said second arm portions displaceable with respect to said first arm portion; and at least one deformation portion for each of said first and second arm portions;

wherein:

as said deformation portion is deformed, a fitting space is formed between said first and second arm portions, and a to-be-shock-absorbed article is held in said fitting space; and said deformation portion comprises:

a V-shaped groove formed at an approximately center of each of said first and second arm portion, and being deformed in a shrinking direction so as to form said fitting space; and a second M-shaped slit formed at said joined portion, and being deformed in a spreading direction so as to form said fitting space.

3. The device as claimed in claim 2, wherein:

said V-shaped groove is formed in each of said first and second arm portions;

said second M-shaped slit is formed at each of the two joined positions; and in a deformed state, said fitting space has a rectangular shape enclosed by said first and second arm portions.

4. The device as claimed in claim 2, wherein:

said first slit is connected with a corner of a central V-shaped portion of three V-shaped portions included in said second M-shaped slit, and, also, divides an inner angle of said central V-shaped portion; and in a deformed state, said central V-shaped portion acts as a corner of said fitting space as it is.

* * * * *